US006951421B2

(12) United States Patent
Crunkleton et al.

(10) Patent No.: US 6,951,421 B2
(45) Date of Patent: Oct. 4, 2005

(54) RECLOSABLE PACKAGING HAVING SLIDER-OPERATED STRING ZIPPER

(75) Inventors: Gregory H. Crunkleton, Nicolson, GA (US); Basil C. Linton, Loganville, GA (US); Eric J. Fenzl, Loganville, GA (US); Robert E. Hogan, Burr Ridge, IL (US)

(73) Assignee: Illinois Tool Works Inc., Glenview, IL (US)

( * ) Notice: Subject to any disclaimer, the term of this patent is extended or adjusted under 35 U.S.C. 154(b) by 111 days.

(21) Appl. No.: 10/367,450

(22) Filed: Feb. 14, 2003

(65) Prior Publication Data

US 2004/0161168 A1 Aug. 19, 2004

(51) Int. Cl.[7] ..... B65D 33/16
(52) U.S. Cl. ..... 383/64; 24/400; 24/415
(58) Field of Search ..... 383/63–34; 24/387–388, 24/399–400, 415

(56) References Cited

U.S. PATENT DOCUMENTS 3,713,923 A * 1/1973 Laguerre ..... 156/66
5,983,466 A 11/1999 Petkovsek
6,088,887 A 7/2000 Bois
6,138,329 A * 10/2000 Johnson ..... 24/584.1
6,220,754 B1 4/2001 Stiglic et al.
6,257,763 B1 7/2001 Stolmeier et al.
6,305,844 B1 10/2001 Bois
6,461,042 B1 * 10/2002 Tomic et al. ..... 383/64
6,477,821 B1 11/2002 Bois
6,490,769 B2 * 12/2002 Siegel ..... 24/415
6,568,046 B1 * 5/2003 Savicki et al. ..... 24/387
6,595,689 B1 * 7/2003 Borchardt et al. ..... 383/64

FOREIGN PATENT DOCUMENTS

DE 3208245 A1 9/1983
WO WO 02/26068 A1 4/2002

* cited by examiner

*Primary Examiner*—Jes F. Pascua
(74) *Attorney, Agent, or Firm*—Ostrager Chong Flaherty & Broitman P.C.

(57) ABSTRACT

A reclosable package or bag having a slider-operated string zipper. The respective parts of the string zipper comprise a respective base strip and a respective set of profiled closure elements projecting from a front side of the base strip. The upper margins of the respective bag walls are joined to the backs of the respective base strips. The slider rides on the string zipper with the upper margins of the bag film being disposed between the zipper and the slider.

19 Claims, 9 Drawing Sheets

RECLOSABLE PACKAGING HAVING SLIDER-OPERATED STRING ZIPPER

BACKGROUND OF THE INVENTION

This invention generally relates to zippers for use in reclosable packaging, such as bags or pouches. In particular, the invention relates to string zippers for reclosable bags.

Reclosable bags are finding ever-growing acceptance as primary packaging, particularly as packaging for foodstuffs such as cereal, fresh vegetables, snacks and the like. Such bags provide the consumer with the ability to readily store, in a closed, if not sealed, package any unused portion of the packaged product even after the package is initially opened.

Reclosable bags comprise a receptacle having a mouth with a zipper for opening and closing. In recent years, many zippers have been designed to operate with a slider mounted thereon. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled closure strips that are joined at opposite ends of the bag mouth. The profiles of interlockable plastic zipper parts can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage. In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction.

In the past, many interlocking closure strips were formed integrally with the bag making film, for example, by extruding the bag making film with the closure strips formed on the film. Such constructions, however, were limited by the conditions required to extrude both the film and zipper together. To avoid such limitations, many bag designs entail separate extrusion of the closure strips, which are subsequently joined to the bag making film, for example, by conduction heat sealing. These separate closure strips typically have flanges extending therefrom in such a way that the flanges can be joined to bag making film in order to attach the closure strips to the film. Previous slider-operated, separately extruded zippers used flange-type constructions.

An alternative zipper design is the so-called flangeless or string zipper, which has no flange portion above or below the interlockable closure profiles. In the case of a string zipper, the bag making film is joined to the backs of the bases of the closure strips. String zippers can be produced at much greater speeds, allow much greater footage to be wound on a spool, thereby requiring less set-up time, and use less material than flanged zippers, enabling a substantial reduction in the cost of manufacture and processing.

There is a continuing need for new designs for reclosable bags that can be manufactured at low cost.

BRIEF DESCRIPTION OF THE INVENTION

The present invention is directed to a reclosable package comprising a receptacle having an interior volume, and a slider-operated string zipper attached to the package for allowing access to the interior volume.

One aspect of the invention is a reclosable package comprising a receptacle having a mouth, a string zipper joined to the receptacle at the mouth, the string zipper comprising first and second mutually interlockable zipper parts, and a slider mounted over the string zipper. The slider causes the first and second zipper parts to separate when the slider is moved in one direction along the string zipper, and causes the first and second zipper parts to interlock when the slider is moved in an opposite direction along the string zipper.

Another aspect of the invention is a reclosable package comprising: a receptacle having a mouth and comprising first and second walls; a zipper joined to the receptacle at the mouth, the zipper comprising first and second mutually interlockable zipper parts, the first zipper part comprising a first base strip having a front side and a back, and a first set of closure elements projecting from the front side of the first base strip, and the second zipper part comprising a second base strip having a front side and a back, and a second set of closure elements projecting from the front side of the second strip; and a slider mounted over the zipper to cause the first and second zipper parts to separate when the slider is moved in one direction along the zipper and to cause the first and second zipper parts to interlock when the slider is moved in an opposite direction along the zipper. A portion of the first wall is joined to the back of the first base strip while a portion of the second wall is joined to the back of the second base strip. The slider rides along the zipper with the joined wall portions being disposed between the slider and the zipper.

A further aspect of the invention is a string zipper comprising first and second mutually interlockable zipper parts, wherein the first zipper part comprises first and second female profiles, a sealing bridge having one end connected to the first female profile and another end connected to the second female profile, and a rounded rib projecting outward from the second female profile near a bottom of the first zipper part, and the second zipper part comprises a base having top and bottom edges, first and second male members having stems connected to the base at respective positions removed from the top and bottom edges, and heads that interlock in the first and second female profiles respectively, wherein a face of the top edge of the base is inclined approximately along a tangent to the first female profile.

Yet another aspect of the invention is a slider comprising a top wall, a first sidewall depending downward from the top wall and having a first length, a second sidewall depending downward from the top wall and having a second length greater than the first length, and a plow depending downward from a central portion of the top wall and having a third length greater than the second length.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
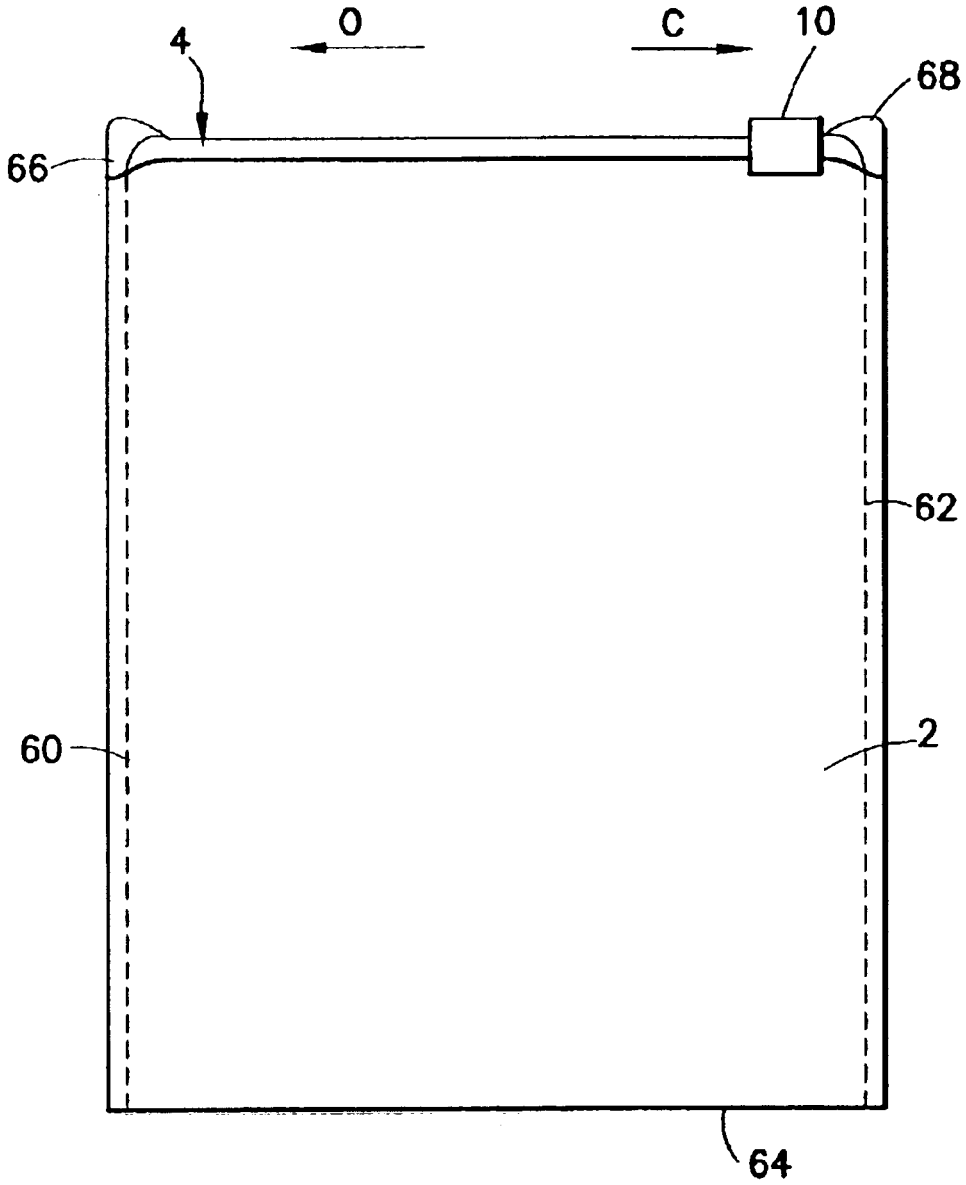
FIG. 1 is a drawing showing a reclosable package having a slider-operated zipper with end stops.

A reclosable package or bag 2 having a flexible plastic string zipper 4 operated by manipulation of a slider 10 is shown in FIG. 1. It should be understood that the slider-zipper assemblies disclosed herein can be installed in a reclosable package or bag of the type shown in FIG. 1 or other types of reclosable packages having different structures.

The bag 2 may be made from any suitable film material, including thermoplastic film materials such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive. The thickness of the film is preferably 2 mils or less. The bag 2 comprises opposing walls (only the front panel is visible in FIG. 1) that may be secured together at opposite side edges of the bag by seams 60 and 62 (indicated by dashed lines). The opposing bottoms of the walls may be joined, for example, by means of a heat seal made in conventional fashion, e.g., by application of heat and pressure. Typically, however, the bottom of the package is formed by a fold 64 in the original packaging film, as depicted in FIG. 1.

Figure 2:
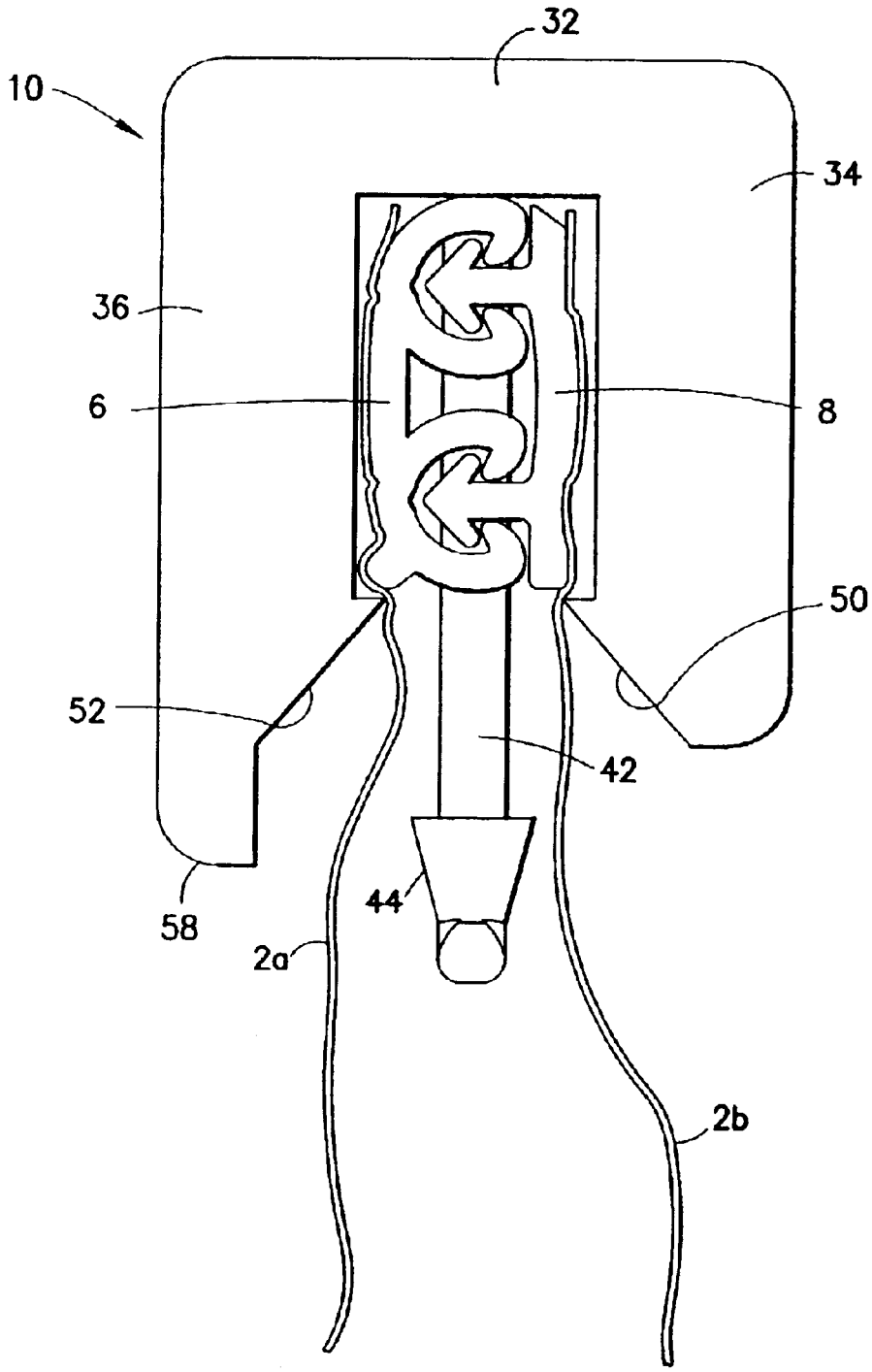
FIG. 2 is a drawing showing a partially sectioned view of a slider-string zipper assembly in accordance with one embodiment of the invention. The zipper is shown sectioned in a plane in front of the closing end of the slider.

At its top end, the bag 2 has an openable mouth, on the inside of which is an extruded plastic string zipper 4. The string zipper 4 comprises a pair of interlockable zipper parts or closure strips 6 and 8 (best seen in FIG. 2). Although FIG. 2 shows a rib and groove arrangement, the profiles of the zipper halves may take any form. For example, the string zipper may comprise interlocking rib and groove elements (as shown in FIG. 2) or alternating hook-shaped closure elements. The preferred zipper material is polyethylene or polypropylene. The top edges of the front and rear bag walls 2*a* and 2*b* (see FIG. 2) are respectively sealed to the backs of the zipper halves 6 and 8 by a conventional conduction heat sealing technique.

The string zipper is operated by sliding the slider 10 along the zipper parts. As the slider moves across the zipper, the zipper is opened or closed. As shown in FIG. 1, the slider is slidable along the zipper in a closing direction "C", causing the zipper halves to become engaged, or in an opening direction "O", causing the zipper halves to become disengaged.

The bag shown in FIG. 1 further comprises end stops 66 and 68 for preventing the slider from sliding off the end of the zipper when the slider reaches the zipper closed or fully opened position. Such end stops perform dual functions, serving as stops to prevent the slider from going off the end of the zipper and also holding the two zipper profiles together to prevent the bag from opening in response to stresses applied to the profiles through normal use of the bag. In accordance with one embodiment of the invention, the end stops comprise stomped areas on the zipper parts themselves. The stomped end stops comprise sections of the zipper parts that have been fused together and flattened at the ends of the zipper. During deformation, thermoplastic zipper material flows upward such that the end stops are raised in height above the peak of the undeformed zipper on which the slider rides. Such stomping can be carried out using ultrasonic welding equipment of the type disclosed in U.S. patent application Ser. No. 10/113,489, entitled "Method and Apparatus for Ultrasonically Stomping Slider End Stops on Zipper". The horn and anvil of the ultrasonic welding apparatus disclosed therein are specifically designed so that the ultrasonic stomping operation create a vertical hump on the zipper to stop the slider, while at the same time preserving the base of the zipper profile to resist pull-off of the slider. Sufficient heat penetrates into the mass of the zipper profile in the end stop areas to fuse the zipper parts together, posing an obstacle to the slider plow. Also, a pair of V-shaped notches can be formed in opposite ends of the slider top wall for receiving the vertical humps of the end stops. This allows the plow to abut against the fused end of the zipper.

In accordance with one embodiment of the invention, the zipper halves 6 and 8 comprise interlocking rib and groove elements, which are well known in the art. Many configurations of rib and groove elements may be employed to perform any one of a number of required functions. For instance, specific rib and groove elements may be employed to permit the package to be more easily opened from the outside than from the inside, so that the tension produced by the contents of the package will not accidentally open the rib and groove elements.

Figure 3:
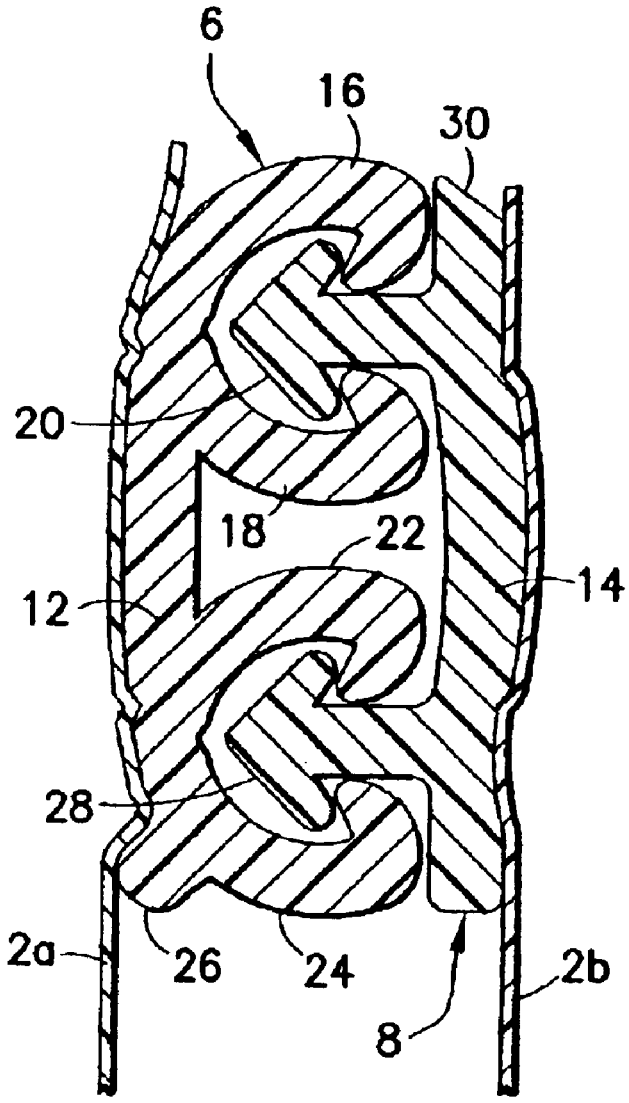
FIG. 3 is a drawing showing a sectioned view of the string zipper incorporated in the assembly depicted in FIG. 2.

One embodiment of a string zipper suitable for use in the present invention is seen in FIG. 2 and is shown in greater detail in FIG. 3. Numerals 2*a* and 2*b* indicate opposing walls (made, e.g., of plastic film) of a receptacle. The walls 2*a* and 2*b* of the receptacle are joined to the zipper parts 6 and 8, e.g., by heat sealing. The zipper in this example is an extruded plastic structure comprising mutually interlockable profiled zipper parts 6 and 8. Zipper part 8 comprises a base and two generally arrow-shaped rib-like male closure elements or members 20 and 28 projecting from a base 14, and two pairs of hook-shaped gripper jaws connected by a sealing bridge 12. The pairs of gripper jaws form respective complementary female profiles for receiving the male profiles of closure elements 20 and 28. More specifically, jaws 16 and 18 receive and interlock with the male element 20, while jaws 22 and 24 receive and interlock with the male element 28. Alternatively, one zipper part could have one male profile and one female profile, while the other zipper part has one female profile and one male profile, or the respective zipper parts could each have more than two male or female profiles.

The sealing bridge 12 and the base 14 are resiliently flexible self-supporting structures having a thickness greater than the thickness of the bag film. The male closure elements are integrally formed with the base 14, while the female closure elements are integrally formed with the sealing bridge 12. The upper margins of the walls 2*a* and 2*b* of the bag are joined to the backs of the sealing bridge 12 and the base 14 respectively, as is best seen in FIG. 3. The upper margins of the bag film may have short free ends that extend beyond the termination points depicted in FIG. 3, provided that the free ends are not so long as to interfere with travel of the slider along the zipper or become entangled with the zipper profiles.

The end face of upper edge 30 of the base 14 that carries the male closure elements 20 and 28 is inclined at about a 45° angle to facilitate loading of the slider onto the zipper from above without snagging on a corner of the upper edge. The bottom edge 8 of the base 14 cooperates with a retaining ledge on the slider (to be described later) to increase the slider-pull-off resistance. For the same purpose, a rib 26 is formed on zipper part 6, the rib 26 cooperating with a retaining ledge on the other side of the slider.

In a typical zipper, the profile of each male member has a stem flanked by shoulders or teeth, and a tip of the profile points toward the opposing female profile, the tip being the point of the male member furthest away from the base of the profiled structure. Each female profile comprises a pair of gripper jaws extending from a base or root of the female profile. Each jaw comprises a wall and a hook integrally formed at the distal end of the respective wall. The hooks are inclined and generally directed toward each other, the distal ends of the hooks defining a mouth that communicates with a groove defined by the walls and root of the female profile.

The groove of each female profile receives the head of a respective male member when the zipper is closed, as best seen in FIG. 3. Closing of the zipper is accomplished as follows. When the male members 20 and 28 are properly aligned with and then moved into engagement with the opposing female profiles, the head of each male member will penetrate the opening in the opposing female profile. As the head of each male member penetrates, the resilient hooks of the opposing gripper jaws are pushed apart by the inclined surfaces running from the tip to the shoulders of each male member. The force exerted on the hooks of each female member by the head of the penetrating male member is transferred to the resilient walls of the gripper jaws, causing those walls to flex outwardly. The walls are flexed outward, in opposite directions, until the hooks of the female member pass by and snap into interlocking relation behind the shoulders of the male member. The heads of the male members 20 and 28 are received in the grooves of the respective female profiles and held there by the interlocked hooks, this situation constituting the closed state of the zipper.

To open the closed zipper, the zipper parts 6 and 8 are pulled apart with sufficient force to pull the heads of the male members out of the female profiles. When the shoulders of the male members clear the hooks of the outwardly flexed gripper jaws, the male and female members are no longer interlocked and the zipper is open.

Numerous configurations for the interlockable male and female members are known in the art. The present invention is not limited to use with male members having an arrow-shaped head. Male members having expanded heads with other shapes may be used. For example, instead of an expanded head having a pointed tip, the front face of the expanded head may be rounded. In other words, the head could have a semicircular profile instead of a triangular profile. Alternatively, the expanded head of the male member could have a trapezoidal profile.

As seen in FIG. 2, the slider 10 for opening or closing the reclosable zipper is generally shaped so that the slider straddles the zipper profiles. The upper margins of the bag walls 2*a* and 2*b*, which are joined to the backs of the zipper parts 6 and 8, are disposed between the respective zipper parts and the respective side walls of the slider.

FIGS. 4–8 depict one embodiment of a slider in accordance with the invention. The slider 10 comprises a top wall 32, a pair of side walls 34 and 36 connected to opposing sides of the top wall 32, the top wall 32 and side walls 34, 36 forming a tunnel for passage of the string zipper therethrough. The ends of the slider are open to allow the zipper to pass through. The width of the tunnel is substantially constant along the section that is divided by the plow and then narrows from a point proximal to the end of the plow to the closing window at one end face of the slider. The narrowing section of the tunnel is formed by the substantially planar, inclined interior surfaces 54 and 56 (see FIG. 8), which converge toward the closing window of the slider. The inclined surfaces 54, 56 funnel or squeeze the zipper parts toward each other, causing the zipper profiles to interlock, as the slider is moved in the closing direction. The sidewalls 34 and 36 are formed with concave curved indentations where the user may place the tips of an index finger and a thumb for gripping the slider. Alternatively, convexities (e.g., ribs) could be formed on the sides of the slider to facilitate grasping.

The slider 10 also comprises a plow or divider 42 that depends downward from a central portion of the top wall 32 to an elevation below the lowermost portions of each sidewalls. The plow is disposed between opposing sections of the zipper parts that pass through the tunnel. In this first embodiment, a wedge-shaped body 44 is disposed near the distal end of the plow 42. However, as will be seen when the embodiment of FIGS. 9–12 is described, the wedge-shaped body is optional. The width of the wedge shape of increases linearly toward the slider top wall 32. The tip of the plow 42 is truncated and has rounded edges (best seen in FIG. 4) and flattened corners 46 (see FIG. 8) at opposing ends for facilitating insertion of the plow between the zipper profiles without snagging.

Figure 8:
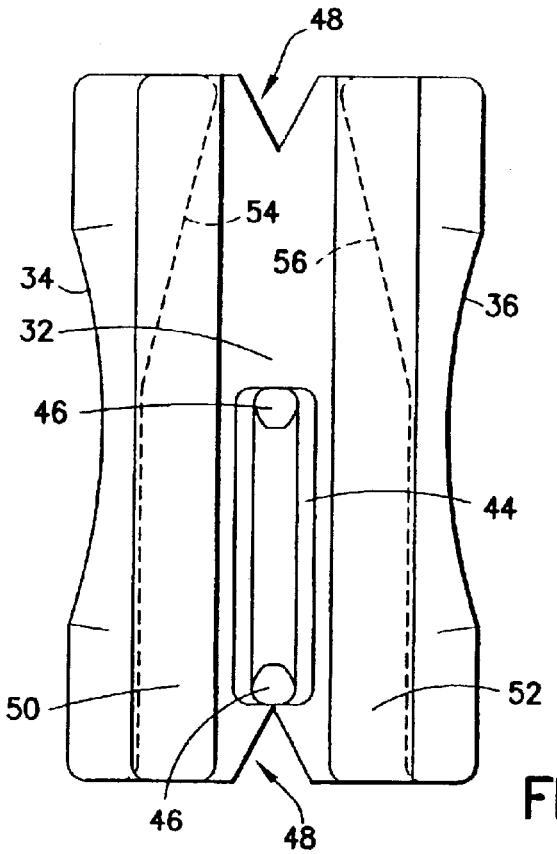
FIG. 8 is a drawing showing a bottom view of the slider depicted in FIG. 4.

The length of the wedge 44 is best seen in FIG. 8. The plow 42 comprises a beam having a cross-sectional shape that is a rectangle with rounded corners. The axis of the beam is generally perpendicular to the top wall of the slider. As the slider is moved in the opening direction (i.e., with the closing end leading), the plow 42 pries the impinging sections of zipper parts 6 and 8 apart. The plow 42 divides the closing end of the slider tunnel into respective passages for the separated zipper parts to pass through.

The slider 10 further comprises a retaining projection or ledge 38 that projects inward from the side wall 34 and a retaining projection or ledge 40 that projects inward from the side wall 36. The ledges 38 and 40 project toward each other, forming respective latches for latching the slider onto the zipper. The ledges 38 and 40 have substantially coplanar, generally horizontal upper surfaces on which the bottom edges of the zipper profiles can sit, thereby effectively latching the slider under the bottom edges of the zipper parts to increase slider pull-off resistance.

The ledges 38 and 40 further comprise respective inclined bottom surfaces that extend downward and outward from the respective inner edges of the generally horizontal surfaces. In the embodiment of the slider depicted in FIGS. 4–8, the inclined surfaces 50 and 52 are each substantially planar, with the respective planes of these inclined surfaces intersecting at a line inside the tunnel that is parallel to the longitudinal axis of the slider. The inclined surfaces 50 and 52 serve to guide the respective zipper parts 6 and 8 into the slider tunnel during insertion of the slider onto the zipper, e.g., by vertical descent from a position above an open section of the upright zipper. The sliders are typically inserted at spaced intervals onto a bag with string zipper that is intermittently advanced in a machine direction on automated slider insertion equipment.

In the case of a monolithic slider with separating finger or plow, the insertion of the slider on a zipper is problematic because the slider must be clipped over the zipper profiles while (i.e., at the same time) the plow is being inserted between the zipper profiles. This gives rise to conflicting demands that the zipper profiles be pulled apart while being squeezed between the side walls of the descending slider. In the embodiment of the slider depicted in FIGS. 4–8, the wedge 44 is disposed at an elevation below the elevation of the guide surfaces 50, 52. As a result, during an initial slider descent, the inclined surfaces on the wedge 44 facilitate insertion of the plow between the separated zipper profiles; thereafter, during further slider descent, the guide surfaces 50 and 52 guide the zipper parts 6 and 8 into the slider tunnel.

Systems for transporting sliders to a slider insertion device are disclosed in U.S. patent application Ser. No. 10/106,687 (incorporated by reference herein) filed on Mar. 25, 2002 and entitled "System for Transporting Sliders for Zipper Bags". That application discloses feeding sliders into a slider insertion device by means of a feeder tube that only accepts correctly oriented sliders having an asymmetric profile, i.e., one leg of the slider is longer than the other leg. Similarly, the slider shown in FIGS. 4–8 has one leg (i.e., side wall) longer than the other, to wit, an extension 58 of side wall 36 projects to an elevation lower than the bottom edge of the opposing side wall 34 (e.g., see FIG. 5). The sliders are launched into the feeder tube by a sender apparatus that is controlled by a programmable controller based on feedback received by the controller from various sensors that detect the presence or absence of sliders at particular locations in the slider transport system. The sliders are pneumatically transported in predetermined quantities from a supply of sliders, e.g., a vibratory hopper, to a loading rack built into or mounted over the slider insertion device.

As best seen in FIG. 8, a pair of V-shaped notches 48 are formed at opposite ends of the top wall 32 of the slider. The notch 48 at the closing end of the slider receives a portion of the vertical hump of slider end stop 66 when the slider is in the zipper-open park position, whereas the notch 48 at the opening end of the slider receives a portion of the vertical hump of slider end stop 68 when the slider is in the zipper-closed park position. Thus the notches 48 allow the slider to travel further into the stomped or presealed areas. In the case of the zipper-closed park position of the slider, the notch at the opening end of the slider reduces the size of the open area of the zipper between the plow and the end stop. In the case of the zipper-open park position of the slider, the notch at the closing end of the slider increases the length of the open mouth section by the length of the notch.

The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

Figure 4:
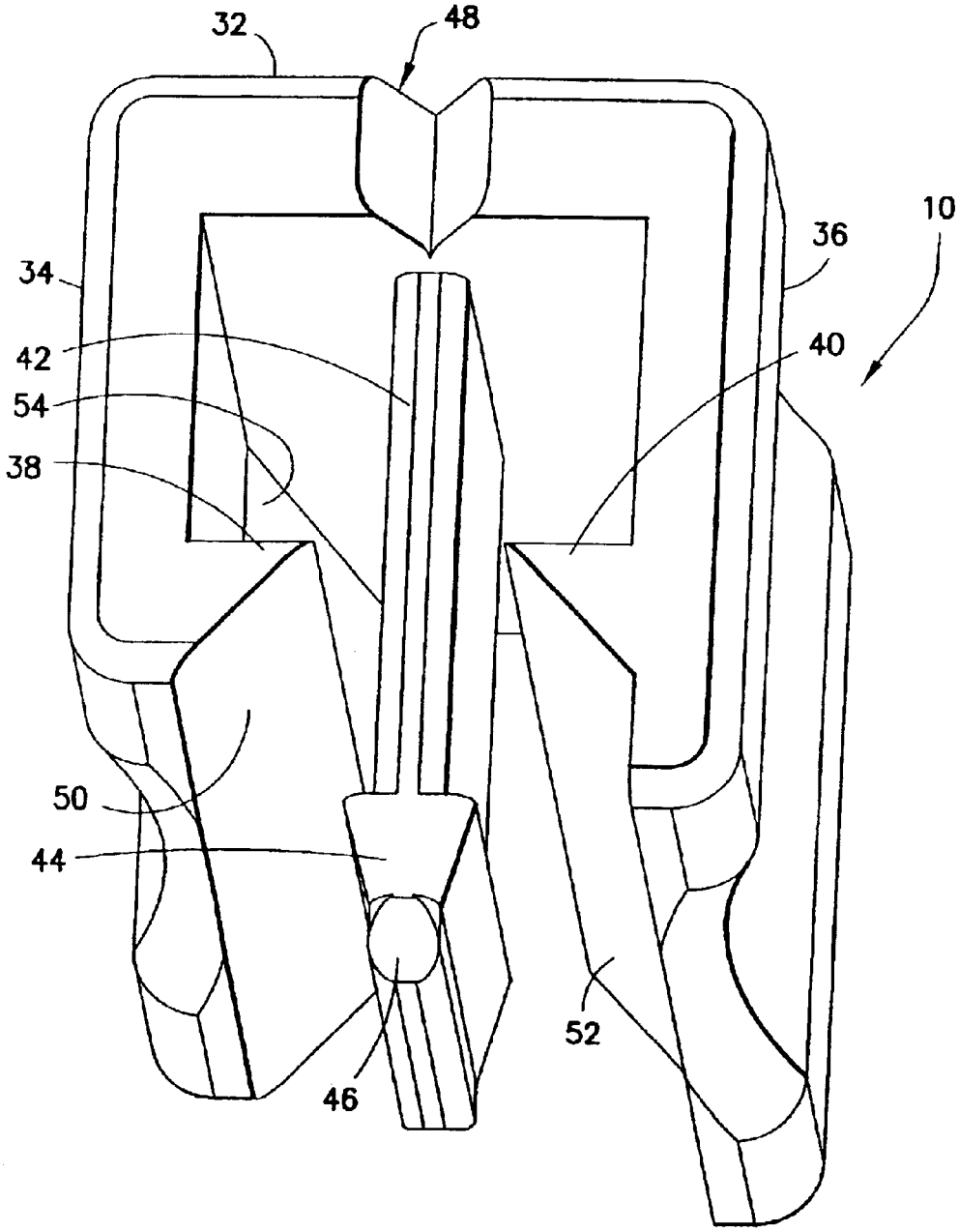
FIG. 4 is a drawing showing an isometric view of the slider incorporated in the assembly depicted in FIG. 2.
Figure 5:
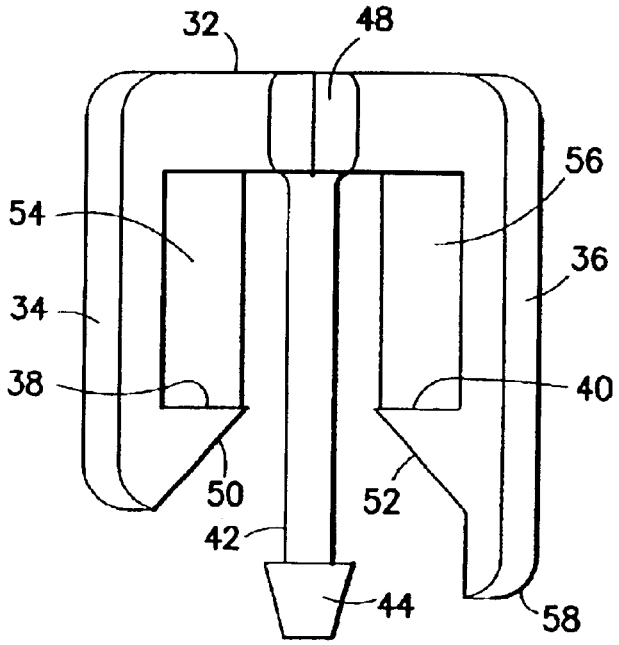
FIG. 5 is a drawing showing an opening end view of the slider depicted in FIG. 4.
Figure 6:
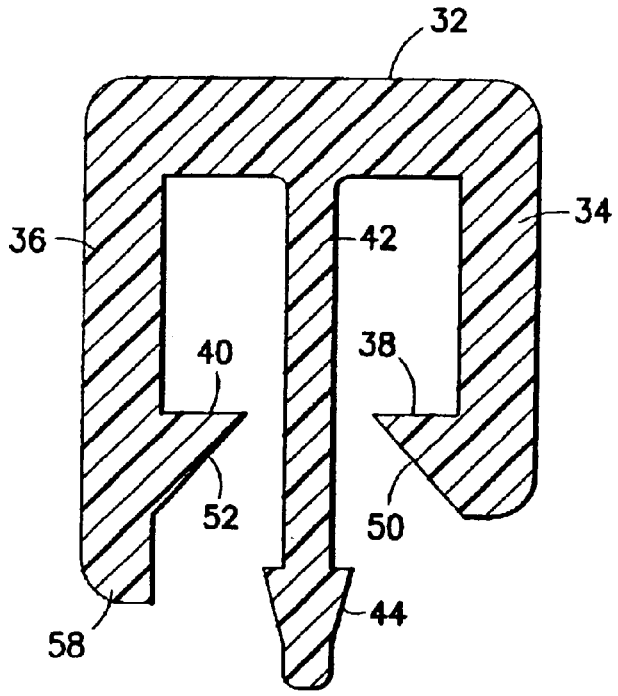
FIG. 6 is a drawing showing a sectional view of the slider depicted in FIG. 4, the section being taken along a transverse plane that intersects the plow.
Figure 7:
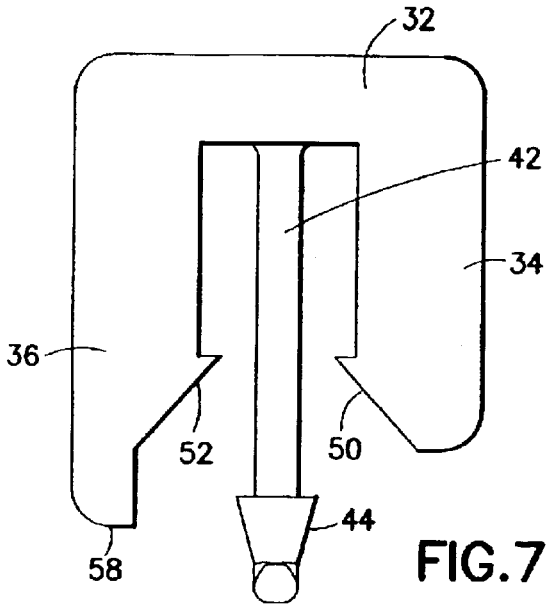
FIG. 7 is a drawing showing a closing end view of the slider depicted in FIG. 4.
Figure 9:
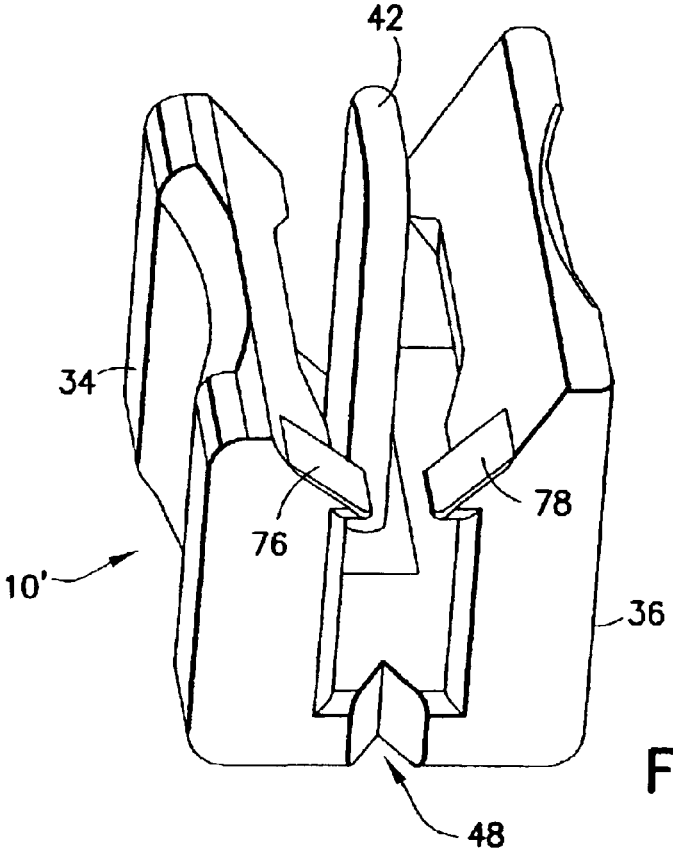
FIG. 9 is a drawing showing an isometric view of an upside-down slider in accordance with another embodiment of the invention.
Figure 10:
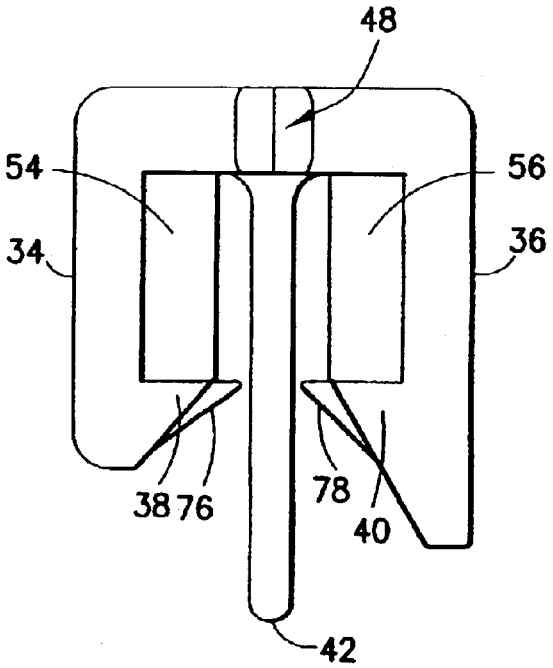
FIGS. 10–12 are drawings showing front, top and side views of the slider depicted in FIG. 9.
Figure 11:
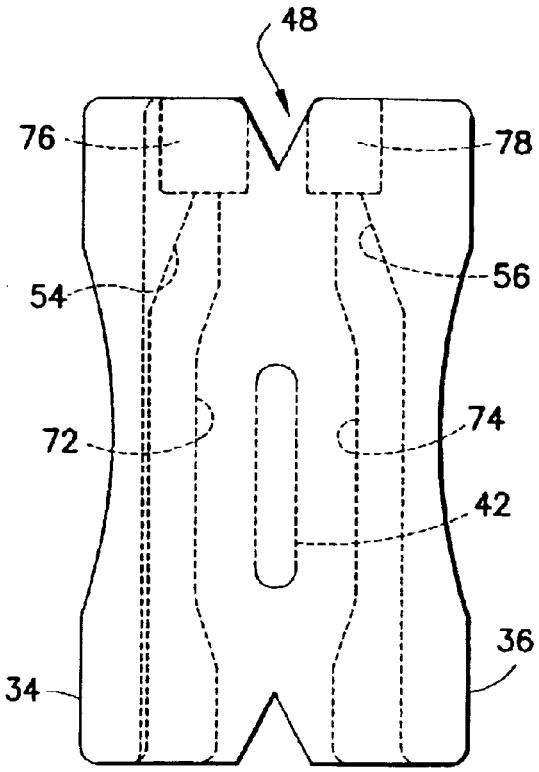
Figure 12:
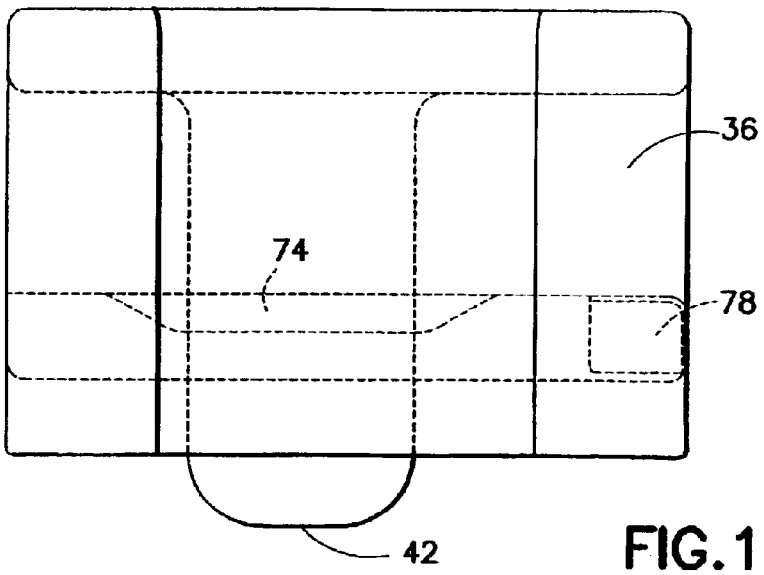

FIG. 9 shows a slider in accordance with an alternative embodiment of the invention. One respect in which the slider shown in FIG. 9 differs from the slider shown in FIG. 4 is that the former lacks a wedge-shaped body on the plow. Instead the plow 42 shown in FIG. 9 is a flat beam generally rectangular in shape with rounded corners and rounded edges. The plow extends generally perpendicular to the top wall of the slider, as best seen in FIG. 10. The sidewall 34 depends downward from one side of the top wall and has a first length, the sidewall depends downward from the other side of the top wall and has a second length greater than the length of sidewall 34, and the plow 42 depends downward from a central portion of the top wall and has a third length greater than the length of sidewall 36, as seen in FIGS. 10 and 12. As seen in FIG. 11, the plow 42 is placed along the centerline of the slider and is located closer to the opening end than to the closing end of the slider. The walls 54 and 56 squeeze the zipper parts together when the slider is moved along the zipper in the closing direction. The slider also has a pair of notches 48 formed in the opposite ends of the slider top wall for receiving a portion of a respective slider end stop formed on the ends of the zipper, as previously described with reference to the slider shown in FIG. 4.

The slider shown in FIG. 9 further differs from the slider shown in FIG. 4 in that further structural features have been added to increase the resistance of the slider to being pulled up and off the zipper. While FIG. 4 shows a slider wherein the retaining ledges 38 and 40 extend in mutual parallel relationship along the length of the slider, the slider shown in FIG. 9 has retaining ledges 38 and 40 that are relieved in the central zone to facilitate insertion of the respective zipper parts into the respective spaces on either side of the plow 42. The relieved areas are respectively indicated by the dashed lines bearing numerals 72 and 74 in FIG. 11. The slider shown in FIG. 10 also has a pair of opposing retaining projections 76 and 78 which are integrally formed on respective zones on the retaining ledges 38 and 40 that are adjacent the closing end of the slider. As seen in FIG. 11, the tips of the retaining projections 76 and 78 are separated by a gap that is smaller than the gap separating the retaining ledges 38 and 40. This narrower gap allows the projections 76 and 78 to better retain the closed section of zipper therebetween. In contrast, at the other end of the slider, the zipper is open, so the gap between the tips of the retaining ledges 38 and 40 needs to be greater than the gap between the tips of the projections 76 and 78.

Figure 13:
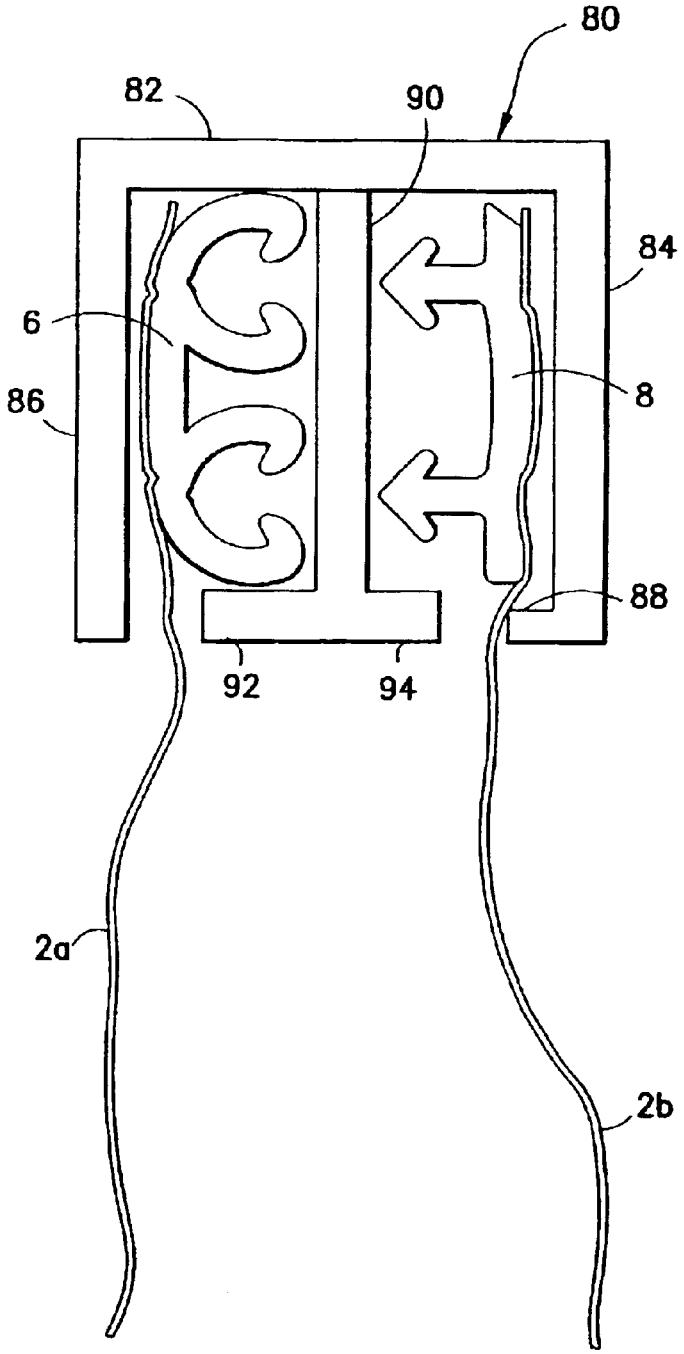
FIG. 13 is a drawing showing a partially sectioned view of a slider-string zipper assembly in accordance with another embodiment of the invention.

A slider-operated string zipper in accordance with another embodiment of the invention is shown in FIG. 13. The string zipper comprises zipper parts 6 and 8 similar to the zipper parts shown in FIGS. 2 and 3. Again the upper margins of the bag walls 2*a* and 2*b* are joined to the backs of the zipper parts. The slider 80 comprises a top wall 82 and sidewalls 84 and 86 depending from and integrally formed with the opposite sides of the top wall. The slider further comprises a plow 90 depending from a central portion of the top wall and dividing the slider tunnel into two channels, one for each zipper part. In accordance with this embodiment, retaining projections 92 and 94 extend in opposite directions from the distal end of the plow 90. The projection 92 is longer than the projection 94 and is designed to retain the zipper part 6 having two female profiles without the assistance of an opposing retaining projection on the sidewall 86. The shorter projection 94, on the other hand, is designed to retain the zipper part 8 having two male profiles with the assistance of an opposing retaining projection 88 projecting from the bottom edge of the sidewall 84.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "package" includes bags, pouches, and any other type of packaging in which a flexible plastic zipper can be incorporated. As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "string zipper" means a zipper comprising two interlockable closure strips that have substantially no flange portions.

What is claimed is:

1. A reclosable package comprising a receptacle having a mouth, a string zipper joined to said receptacle at said mouth, said string zipper comprising first and second mutually interlockable zipper parts, and a slider mounted over said string zipper to cause said first and second zipper parts to separate when said slider is moved in one direction along said string zipper and to cause said first and second zipper parts to interlock when said slider is moved in an opposite direction along said string zipper, wherein said first zipper part comprises first and second female profiles, a sealing bridge having one end connected to said first female profile and another end connected to said second female profile, and a rounded rib projecting outward from said second female profile near a bottom of said first zipper part, and said second zipper part comprises a base having top and bottom edges, first and second male members having stems connected to said base at respective positions removed from said top and bottom edges, and heads that interlock in said first and second female profiles respectively, wherein a face of said top edge of said base is inclined inward and upward approximately along a tangent to said first female profile.

2. The package as recited in claim 1, wherein said slider comprises a plow that pries the sections of said first and second zipper parts lying in its path apart during slider travel in said one direction.

3. The package as recited in claim 2, wherein said slider comprises first and second side walls having first and second projections that respectively project inward beneath respective portions of said first and second zipper parts, said first and second projections resisting pull-off of said slider from said string zipper when said first and second projections are in contact with said first and second zipper parts respectively.

4. The package as recited in claim 2, wherein said plow comprises first and second projections that respectively project outward beneath respective portions of said first and second zipper parts, said first and second projections resisting pull-off of said slider from said string zipper when said first and second projections are in contact with said first and second zipper parts respectively.

5. The package as recited in claim 1, wherein said zipper further comprises first and second slider end stops located at opposing ends of said first and second zipper parts, wherein each of said end stops comprises flattened zipper material, and said slider comprises a top wall with a notch formed at an opening end of said slider, said notch receiving a portion of said first slider end stop when said slider abuts said first slider end stop.

6. The package as recited in claim 1, wherein said receptacle comprises first and second film portions respectively joined to respective backs of said first and second zipper parts, and said slider forms a tunnel for passage of said first and second zipper parts and said first and second film portions joined thereto.

7. The package as recited in claim 1, wherein said slider comprises a top wall, first and second side walls connected to opposing sides of said top wall, said top wall and first and second side walls forming a tunnel for passage of said first and second zipper parts, and a plow depending downward from a central portion of said top wall to an elevation below the lowermost portions of each of said first and second side walls, said plow being disposed between opposing sections of said first and second zipper parts in said tunnel, wherein said plow comprises a wedge-shaped body disposed near or at its distal end.

8. The package as recited in claim 7, wherein said first side wall comprises a first projection that projects toward said second side wall and under a portion of said first zipper part, and said second side wall comprises a second projection that projects toward said first side wall and under a portion of said second zipper part, said first and second projections serving to latch said slider to said zipper.

9. The package as recited in claim 8, wherein said first projection comprises a first generally horizontal surface that serves as a ledge for said first zipper part to sit on and a first inclined surface extending downward and outward from a level of said first generally horizontal surface, while said second projection comprises a second generally horizontal surface that serves as a ledge for said second zipper part to sit on and a second inclined surface extending downward and outward from a level of said second generally horizontal surface.

10. The package as recited in claim 9, wherein said first and second inclined surfaces are substantially planar, the projected planes of said inclined surfaces intersecting inside said tunnel.

11. The package as recited in claim 1, wherein said receptacle comprises first and second walls of film, said first film wall comprising a portion joined to a back of said sealing flange and said second film wall comprising a portion joined to a back of said base.

12. The package as recited in claim 1, wherein said receptacle comprises first and second walls of film, said first film wall comprising a portion joined to a back of said sealing flange and said second film wall comprising a portion joined to a back of said base, and said portion of said first film wall that is joined to said back of said sealing flange starts at an elevation above the lowermost closure element of the lowermost one of said first and second female profiles.

13. A reclosable package comprising:

a receptacle having a mouth and comprising first and second walls;

a zipper joined to said receptacle at said mouth, said zipper comprising first and second mutually interlockable zipper parts, said first zipper part comprising a first base strip having a front side and a back, and a first set of closure elements projecting from said front side of said first base strip, and said second zipper part comprising a second base strip having a front side and a back, and a second set of closure elements projecting from said front side of said second strip; and a slider mounted over said zipper to cause said first and second zipper parts to separate when said slider is moved in one direction along said zipper and to cause said first and second zipper parts to interlock when said slider is moved in an opposite direction along said zipper, wherein a portion of said first wall is joined to said back of said first base strip and a portion of said second wall is joined to said back of said second base strip, and said slider rides along the zipper with the joined wall portions being disposed between said slider and said zipper, and wherein said slider comprises a top wall, first and second side walls connected to opposing sides of said top wall, said top wall and first and second side walls forming a tunnel for passage of said first and second zipper parts, and a plow depending downward from a central portion of said top wall to an elevation below the lowermost portions of each of said first and second side walls, said plow being disposed between opposing sections of said first and second zipper parts in said tunnel, said joined portions of said first and second walls being passed through said tunnel.

14. The package as recited in claim 13, wherein said plow comprises a wedge-shaped body at or near its distal end.

15. The package as recited in claim 13, wherein said first and second side walls respectively comprise first and second ledges designed to retain said slider mounted over said zipper.

16. The package as recited in claim 13, wherein said zipper further comprises first and second slider end stops located at opposing ends of said first and second zipper parts, wherein each of said end stops comprises flattened zipper material, and said slider comprises a top wall with a notch formed at an opening end of said slider, said notch receiving a portion of said first slider end stop when said slider abuts said first slider end stop.

17. The package as recited in claim 13, wherein said portion of said first film wall that is joined to said back of said first base strip starts at an elevation above a closure element carried by said first base strip.

18. The package as recited in claim 13, wherein said slider further comprises first and second zipper retaining ledges projecting in opposite directions from said plow.

19. The package as recited in claim 13, wherein said slider further comprises first and second zipper retaining ledges projecting from said first and second side walls respectively.

* * * * *